US006926148B2

(12) United States Patent
McPhail

(10) Patent No.: US 6,926,148 B2
(45) Date of Patent: Aug. 9, 2005

(54) FILTER CARRIER TRAY

(75) Inventor: Patrick L. McPhail, Minneapolis, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 184 days.

(21) Appl. No.: 10/194,917

(22) Filed: Jul. 12, 2002

(65) Prior Publication Data

US 2003/0042165 A1 Mar. 6, 2003

Related U.S. Application Data

(60) Provisional application No. 60/305,304, filed on Jul. 13, 2001.

(51) Int. Cl.[7] ..... B65D 73/00
(52) U.S. Cl. ..... 206/460; 206/565; 206/701
(58) Field of Search ..... 206/701, 706, 206/707, 561, 562, 564, 460, 813, 565; 210/348, 455

(56) References Cited

U.S. PATENT DOCUMENTS 5,648,136 A * 7/1997 Bird ..... 206/564
5,794,784 A * 8/1998 Murphy ..... 206/562
5,964,352 A * 10/1999 Shoji ..... 206/460
5,988,394 A * 11/1999 Emoto et al. ..... 206/564
6,116,427 A * 9/2000 Wu et al. ..... 206/706
6,412,641 B1 * 7/2002 Anderson ..... 206/460
6,471,063 B2 * 10/2002 Stepp ..... 206/460

* cited by examiner

*Primary Examiner*—Luan K. Bui
(74) *Attorney, Agent, or Firm*—Merchant & Gould P.C.

(57) ABSTRACT

The present invention is directed to a carrier for retaining and transferring filtration devices, as well as to filtration devices configured for placement in the carrier. The carrier generally includes a tray having a plurality of filter seats along with a plurality of holes extending through the tray. Each filter has a release liner that is removably secured to a pressure sensitive adhesive on the filter, and this release liner also contains a tab that extends through one of the holes in the tray and is permanently bonded to the bottom side of the tray.

In use the filters can be removed from the tray by manual or automatic means. During the removal process the release liner separates from the pressure sensitive adhesive on the filter and is retained on the tray. In certain implementations the release liner contains two portions with an adhesive on them—one portion in contact with the filter and one portion in contact with the tray—and these two portions are separated by an area of the release liner that does not contain adhesive.

10 Claims, 5 Drawing Sheets

FILTER CARRIER TRAY

PRIORITY CLAIM

This patent claims priority to the provisional patent application No. 60/305,304 filed Jul. 13, 2001.

FIELD OF THE INVENTION

The present invention is directed to a tray for holding small parts during shipping and handling. More particularly, the invention is directed to an improved tray for retaining filter components.

BACKGROUND

Modem electronic equipment often contains enclosures that must be maintained free from contamination. In the computer industry, adsorbent filters can be used within the enclosures to protect the electronic components from contaminants, such as water vapor, acidic gases, and volatile organic compounds. For example, disk drives often include adsorbent filters within the disk drive and/or are provided over an opening in the disk drive housing to protect the drive components and the disks from contaminants, such as water vapor, hydrocarbons, and acidic gas. Without such protection, these contaminants can lead to stiction, corrosion, and, in some instances, drive failure.

The filters used in electronic enclosures generally contain filter media, a housing, and a pressure sensitive adhesive on the housing to secure the filter inside the electronic enclosure. A removable release liner normally covers the pressure sensitive adhesive. The release liner prevents fouling of the adhesive during shipping and storage, while also avoiding unintentional adherence of the filter to shipping media or to other filters. The filters are usually packaged and shipped on trays containing numerous filters, along with the release liner secured to each one of the filters. The tray and filters are also sealed in order to prevent contamination. During installation in an electronic enclosure each filter is lifted from the tray, the release liner is removed, and the filter is placed within an appropriate enclosure. Traditional shipping methods usually require that the release liner be individually removed from each of the filters as they are installed. These shipping methods can be troublesome because they require a labor-intensive step of individually removing each release liner from each filter as they are installed.

Efforts have been made to produce filters that have release liners secured directly to the carrier tray. Unfortunately, such efforts have not been entirely successful, resulting in problems removing the filter from the release liner and carrier tray. Therefore, a need exists for an improved tray for carrying electronic components.

SUMMARY OF THE INVENTION

The present invention is directed to a holder for electronic components, in particular a tray for holding filters used in electronic enclosures, such as computer hard disk drives. The invention is also directed to filters configured for retention in trays produced in accordance with the invention, including filters having a removable release liner suited to being secured to the tray.

The tray of the present invention can hold numerous filters during shipping and handing. The tray allows the filters to be retained in a precise position so that they can be removed and installed in an electronic enclosure by automated equipment. Each tray generally includes filter seats into which each of the filters is placed. These filter seats, generally consisting of depressions or recesses in the tray (or, alternatively, raised areas on the perimeter of each filter) prevent significant movement of the filters during shipping.

Each filter is also held to the tray by a release liner. The release liners are removably secured to the filter and permanently secured to the tray so that the release liner sticks to the tray when the filter is lifted and removed. Generally the release liner is secured to the bottom of the filter by a pressure sensitive adhesive that will be used to permanently secure the filter to the electronic enclosure. The release liner also generally extends through a hole in the tray to be secured to the bottom side of the tray. Normally the release liner is permanently bonded to the bottom side of the tray such that regular removal of the filter will not pull the release liner from the tray. Thus the bond between the release liner and the tray is significantly stronger then the bond between the release liner and the filter. This bond strength can be attributable to the use of a stronger adhesive to secure the release liner to the underside of the tray. In addition, the stronger bond is derived from the configuration of the filter, tray, and liner. Specifically, when a filter is lifted from the tray the force between the pressure sensitive adhesive on the filter and the release liner is a peeling force, while the force between the release liner and the bottom of the tray is a sheer force.

The above summary of the present invention is not intended to describe each disclosed embodiment or every implementation of the present invention. The figures and the detailed description that follow more particularly exemplify these embodiments.

DRAWINGS

The invention may be more completely understood in consideration of the following detailed description of various embodiments of the invention in connection with the accompanying drawings, in which.

Figure 4A:
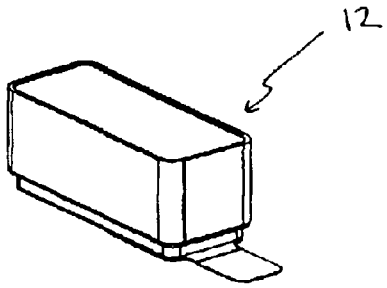
FIG. 4A is a perspective view of a filter constructed and arranged in accordance with the present invention, showing a release liner attached to the filter.
Figure 4B:
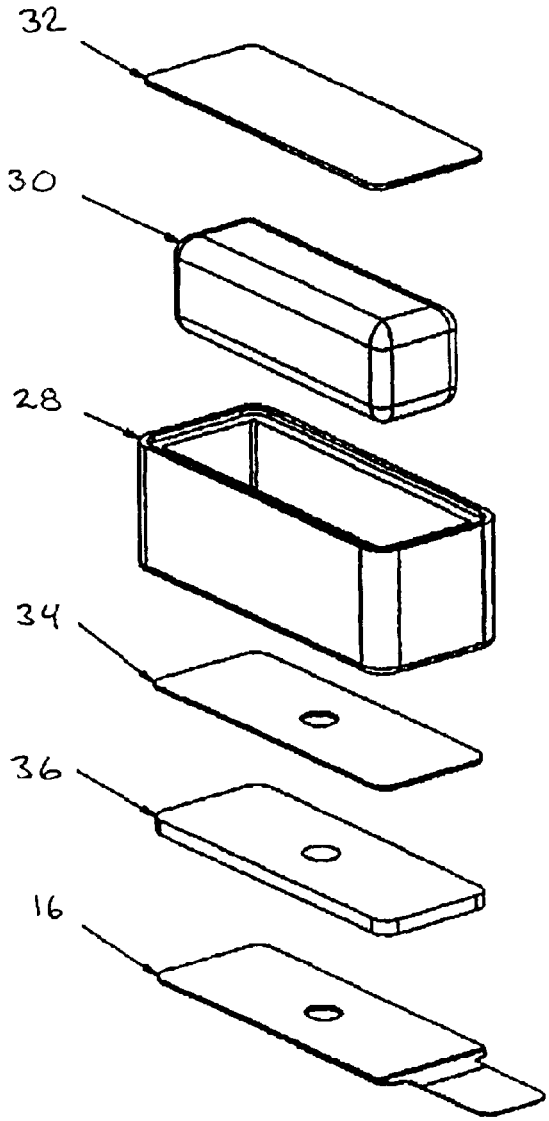

FIG. 4*b* is an exploded perspective view of the filter shown in FIG. 4A.

Figure 5:
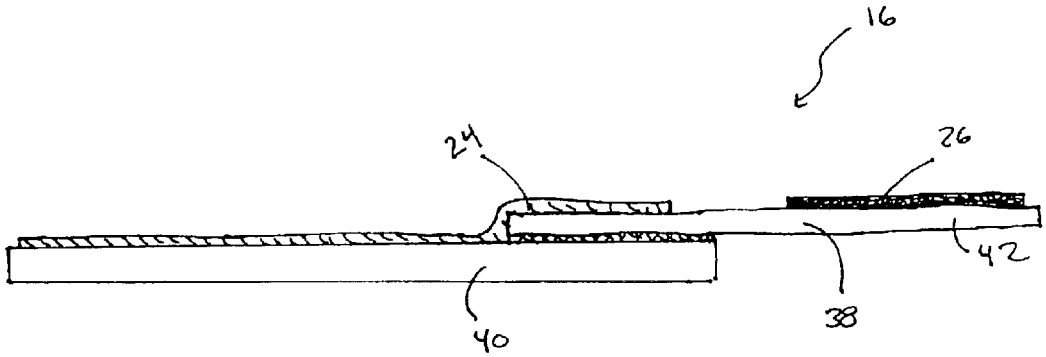

FIG. 5 is a cross sectional view of a release liner constructed and arranged in accordance with an implementation of the invention.

DETAILED DESCRIPTION OF THE INVENTION

The present invention is directed to a carrier for retaining and transferring filtration devices, as well as to filtration devices configured for placement in the carrier. The carrier generally includes a tray having a plurality of filter seats along with a plurality of holes extending through the tray. Each filter has a release liner that is removably secured to a pressure sensitive adhesive on the filter, and this release liner also contains a tab that extends through one of the holes in the tray and is permanently bonded to the bottom side of the tray. The release liners are normally secured to a side of the filter containing a pressure sensitive adhesive, and also extend through holes in the tray to be secured to the bottom side of the tray.

The tray of the present invention is suitable for holding filters during shipping and handing. Each tray includes filter seats into which the filters are placed. These filter seats, generally depressions or recesses in the tray, prevent significant movement of the filters during shipping. The tray allows the filters to be retained in a precise position so that they can easily and efficiently be removed in a manner that leaves the release liner behind. The tray can be constructed such that it is suitable for vacuum packing to keep the filters free of contamination. The tray of the present invention allows for automated dispensing of the filters from the tray while leaving the release liners behind. The tray is generally constructed so that the adhesive tab of the release liner assembly is bonded to the bottom of the tray.

The filter tray of the present invention is designed to retain a plurality of filters (generally more than 20 filters, more typically more than 50 filters, and frequently over 100 filters) for use during storage, shipping, and dispensing. The filters retained on the filter tray are usually installed in sensitive electronic enclosures, such as hard drives, and therefore must be maintained in an extremely clean state. These electronic enclosures are often automatically assembled, and therefore it is generally necessary that the filters be retained in a predictable and precise arrangement that can be accessed by a mechanized picker that removes each filter as it is installed.

Figure 1:
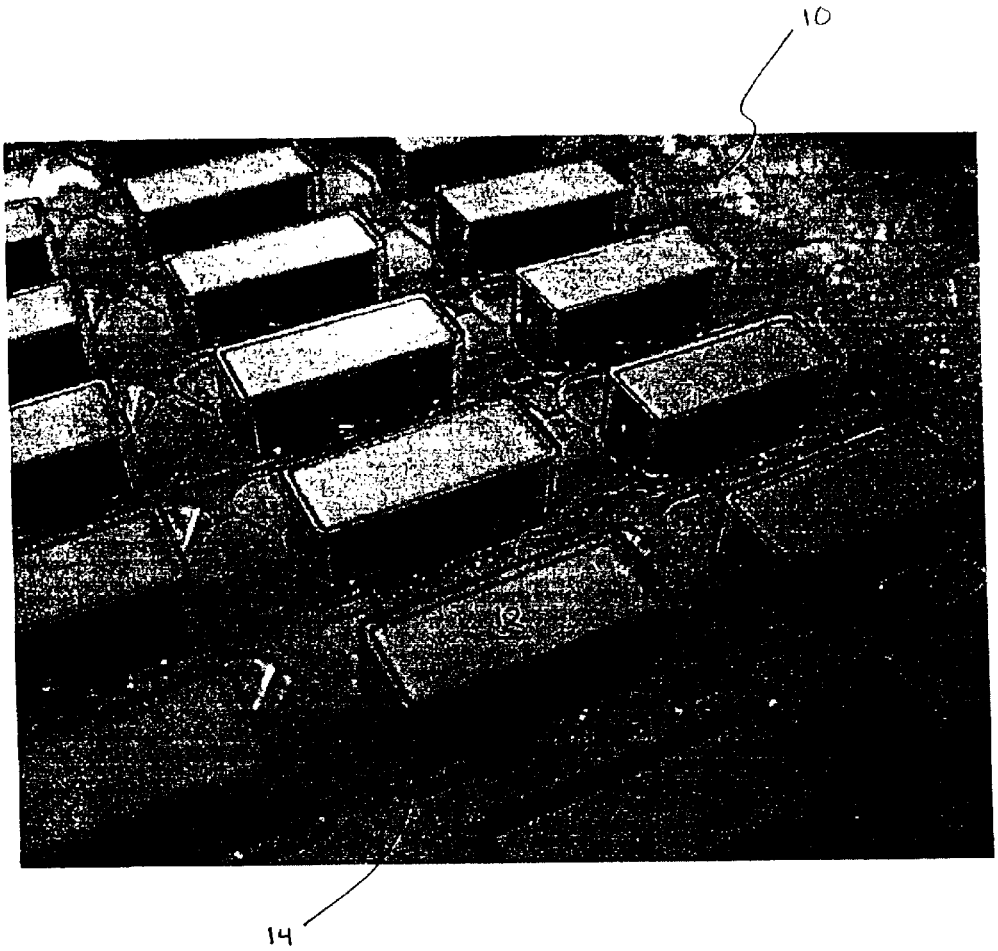
FIG. 1 is a filter-retaining tray constructed and arranged in accordance with the invention, showing the tray with filters present.
Figure 2:
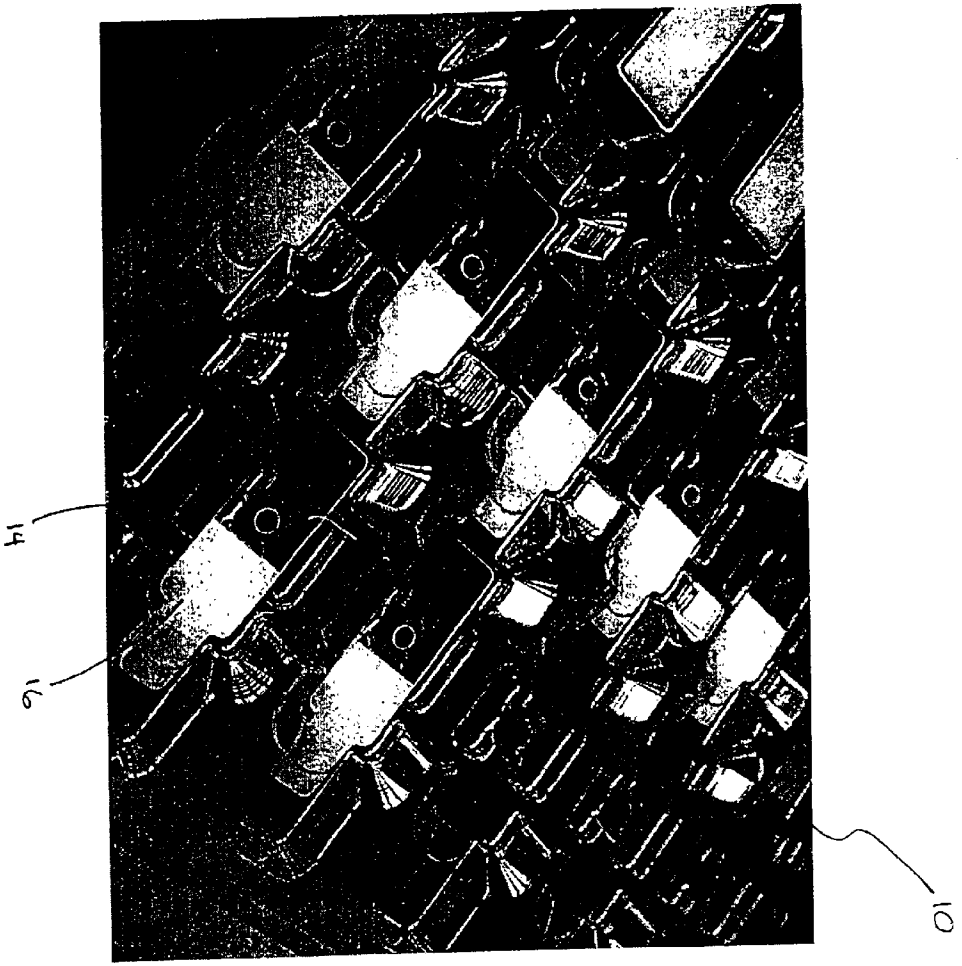
FIG. 2 is a filter-retaining tray constructed and arranged in accordance with the invention, showing the tray with some of the filters removed.

In reference now to FIGS. 1 and 2, a close-up perspective view is shown of a filter tray constructed and arranged in accordance with the present invention. In FIG. 1 the tray 10 contains numerous rectangular filters 12 that are each retained in a depression or seat 14. FIG. 2 depicts a filter tray 10 after some of the filters have been removed to reveal filter seats 14 along with release liners 16. Each release liner 16 is secured directly to the filter tray 10.

In the depicted embodiment the filter tray 10 is a vacuum formed plastic material into which each of the filter seats 14 have been formed. The filter seats 14 in this embodiment prevent the filters 12 from moving horizontally. The release liner secured to the filter tray 10 also helps to prevent movement of the filters 12 placed on the tray.

Figure 3:
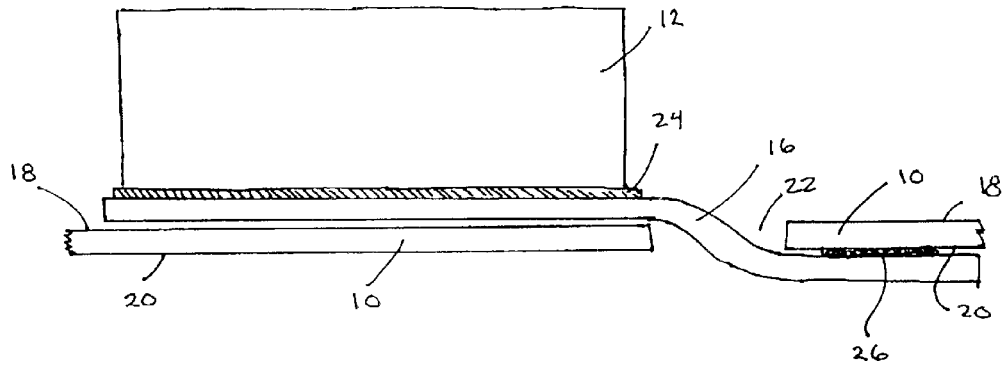
FIG. 3 is a partial cross section of a filter-retaining tray constructed and arranged in accordance with the invention, showing a filter seat and a filter retained on the filter seat.

The individual construction and design of each filter seat and release liner is depicted in additional detail in FIG. 3, which shows a cross section of a portion of a filter tray constructed in accordance with an implementation of the invention. As shown in FIG. 3, the filter tray 10 includes an upper surface 18, a lower surface 20, and hole 22 extending from the upper surface 18 to the lower surface 20. The release liner 16 is secured to the filter 12 as well as to the tray 10. The release liner 16 passes through hole 22 so that it is secured to the lower surface 20 of tray 10. Release liner 16 is normally secured to filter 12 by a pressure sensitive adhesive 24. Pressure sensitive adhesive 24 is normally the same adhesive composition used to permanently secure the filter 12 in an electronic enclosure. Release liner 16 is generally permanently secured to the bottom surface 20 of tray 10 by an adhesive 26. Adhesive 26 prevents removal of the release liner from the bottom surface 20 of tray 10. In general adhesives 24 and 26 are positioned with a gap between them to avoid having the filter 12 stick to the adhesive 26.

In reference now to FIGS. 4A and 4B, an example filter 12 constructed in accordance with the invention is disclosed. FIG. 4A shows the filter in a perspective view, while FIG. 4B shows the filter in an exploded perspective view. Filter 12 is shown as an example, and it will be appreciated that numerous other designs and constructions are possible that are suitable for use with the present invention. Thus, acceptable filters can be larger, smaller, have different orientations, different shapes, different materials, different functions, etc. Filter 12 is shown so as to give one example of how a specific filter can be placed within a tray manufactured in accordance with the invention.

Filter 12 includes a housing 28 containing adsorbent filter media 30, such as activated carbon, along with a non-adsorbent scrim 32 holding the filter media 30 in place. An adhesive layer 34 is placed on the bottom of the housing 28 and secures a foam gasket 36. Foam gasket 36 includes an adhesive on the bottom side that is suitable for bonding to an electronic enclosure. A release liner 16 is positioned on the bottom of this foam gasket 36 and protects the adhesive.

FIG. 5 shows an enlarged cross sectional view of a release liner 16 constructed and arranged in accordance with the invention. The release liner 16 used in the present invention protects the pressure sensitive adhesive 24 that is placed on at least one side of the filter. In addition, the release liner has a tab 38 that extends beyond the filter and which can be bound to the bottom side of the tray using another adhesive composition 26. In certain implementations the release liner contains two portions with an adhesive on them—a first portion 40 in contact with the filter and a second portion 42 in contact with the tray—and these two portions are separated by an area of the release liner that does not contain adhesive. In general the liner 16 is attached to the tray using an adhesive instead of ultrasonic or heat welding because use of an adhesive improves the cycle time during manufacturing and process cleanliness.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

I claim:

1. A carrier for retaining and transferring filtration devices, the carrier comprising:

a) a tray having a first surface, a second surface, and at least one opening extending from the first surface to the second surface; the first surface configured to receive at least one filter element;

b) at least one filter element positioned on the first surface of the tray;

c) a release liner in contact with the filter element and the tray, the release liner having a top surface;

wherein a first portion of the top surface of the release liner contains an adhesive composition in contact with the filter element; a second portion of the top surface of the release liner contains an adhesive composition in contact with the second surface of the tray.

2. The carrier for retaining and transferring filtration devices of claim 1, wherein the top surface of the release liner further comprises a third portion that does not contain an adhesive composition.

3. The carrier for retaining and transferring filtration devices of claim 2, wherein the third portion that does not contain an adhesive composition is intermediate the first and second portions.

4. The carrier for retaining and transferring filtration devices of claim 1, wherein the first surface is configured to receive multiple filter elements.

5. The carrier for retaining and transferring filtration devices of claim 1, wherein the release liner comprises a tab extending from the edge of the filter element.

6. The carrier for retaining and transferring filtration devices of claim 1, wherein the filter element is removable by a vertical lifting motion that leaves the release liner secured to the second surface of the tray.

7. A carrier for retaining and transferring filtration devices, the carrier comprising:

a) at least one filtration device having an adhesive composition at least partially covered by a removable release liner;

b) a tray having an upper surface and a lower surface, the upper surface configured to non-adhesively receive the removable release liner for the at least one filtration device; and c) at least one opening in the tray extending from the upper surface to the lower surface;

wherein the lower surface of the tray is configured and arranged to be secured to the release liner using adhesive composition.

8. The carrier for retaining and transferring filtration devices of claim 7, wherein the release liner has an upper surface containing at least two areas of adhesive: a first area in contact with the filtration device and a second area in contact with the lower surface of the tray.

9. The carrier for retaining and transferring filtration devices of claim 7, wherein the upper surface of the tray is configured to receive multiple filtration devices.

10. The carrier for retaining and transferring filtration devices of claim 7, wherein the release liner comprises a tab extending from the an edge of the filtration device.

* * * * *